United States Patent [19]

Downing

[11] Patent Number: 5,024,420

[45] Date of Patent: Jun. 18, 1991

[54] FOLDABLE HANDRAIL ASSEMBLY

[76] Inventor: Gerald W. Downing, 4621 S. Galapago, Englewood, Colo. 80110

[21] Appl. No.: 435,733

[22] Filed: Oct. 26, 1989

[51] Int. Cl.[5] ..... E04H 17/14

[52] U.S. Cl. ..... 256/67; 52/150; 296/156

[58] Field of Search ..... 256/67, 65, 59; 403/108, 328; 296/156, 162; 52/150, 183

[56] References Cited

U.S. PATENT DOCUMENTS

| | | | |
|---|---|---|---|
| 2,583,786 | 1/1952 | Marzucco | 403/108 X |
| 3,214,187 | 10/1965 | Fuerst | 403/328 X |
| 3,463,457 | 8/1969 | Alexander | 256/65 X |
| 4,006,564 | 2/1977 | Wiese | 256/65 X |
| 4,029,352 | 6/1977 | Evans . | |
| 4,261,550 | 4/1981 | Gregory . | |
| 4,856,761 | 8/1989 | Berner | 256/67 X |

*Primary Examiner*—Peter M. Cuomo

*Attorney, Agent, or Firm*—Fields, Lewis, Pittenger & Rost

[57] ABSTRACT

A foldable handrail assembly for use with an entrance in a wall of an enclosure such as a trailer or the like. The foldable handrail assembly includes a handrail which may be extended from and locked at an angle to the trailer wall for use with the entrance or retracted and folded flat against the wall for storage. The foldable handrail assembly includes the handrail, a first mounting bracket, a length adjustable brace, a stabilizer rod and a stabilizer rod mounting bracket. The stabilizer rod as well as the stabilizer rod mounting bracket may be mounted in either an upper or lower position with respect to the handrail to prevent interference with existing components of the wall.

17 Claims, 3 Drawing Sheets

FOLDABLE HANDRAIL ASSEMBLY

FIELD OF THE INVENTION

The present invention relates to handrails and more particularly to a foldable handrail assembly that may be mounted to and folded flat against a wall having a doorway such as is found in a mobile home, trailer, or like enclosure and outwardly extended and locked for use.

BACKGROUND OF THE INVENTION

Foldable handrail assemblies for use with entrances in an enclosed structure or the like are known in the prior art. In general, a foldable handrail assembly can be mounted to a structure such as the outside wall of a trailer or mobile home and either folded flat against the wall for storage or extended outwardly and downwardly from the wall for use with the entrance. These handrail assemblies are frequently used with stairsteps in stepping into or out of the structure. U.S. Pat. No. 4,029,352 to Evans and U.S. Pat. No. 4,261,550 to Gregory are representative of these prior art foldable handrail assemblies.

This type of foldable handrail assembly is often retrofitted adjacent to an entrance or to a doorway in a wall of an enclosure typically having stairsteps, such as are found in trailers, recreational vehicles, motor homes and pickup campers. Interference with existing components of the structure wall sometimes presents mounting problems for these handrail assemblies. The present invention is directed to a foldable handrail assembly with a construction that allows the handrail and supporting structure to be mounted in more than one position on the enclosure wall. This helps to overcome interference problems with existing components of the enclosure or wall and allows the handrail assembly to be more easily located in a suitable position or location.

SUMMARY OF THE INVENTION

A foldable handrail assembly that can be mounted to a structure such as the outside wall and to one side of an entrance in the wall such as is present in a trailer, camper, mobile home and the like. The handrail assembly includes a handrail that may be folded flat against and secured to the wall of the structure for storage or outwardly and downwardly extended and locked for use with the entrance. The foldable handrail assembly generally stated includes the handrail, a first mounting bracket, a length adjustable brace, a stabilizer rod, and a stabilizer rod mounting bracket. The stabilizer rod and stabilizer mounting bracket may be mounted at different positions such as an either a lower or an upper position with respect to the handrail. Additionally, the handrail may be mounted either to the left or to the right of the entrance.

The inner end of the handrail is pivotably attached to an outside wall of the structure mounted either to the first mounting bracket or to the stabilizer rod mounting bracket depending on the positioning of the stabilizer rod. Likewise, the lower end of the length adjustable brace can be pivotably attached to either the first mounting bracket or to the stabilizer rod mounting bracket depending on the positioning of the stabilizer rod.

The foldable handrail assembly also includes locking means for locking the length adjustable brace and handrail in the extended position at a desired angle. In addition, clip means attached to the structure wall are provided to hold the handrail in the storage position folded flat against and generally parallel to the wall.

Many other objects and purposes of the invention will be clear from the detailed description of the drawing.

DETAILED DESCRIPTION OF THE DRAWING

Figure 1:
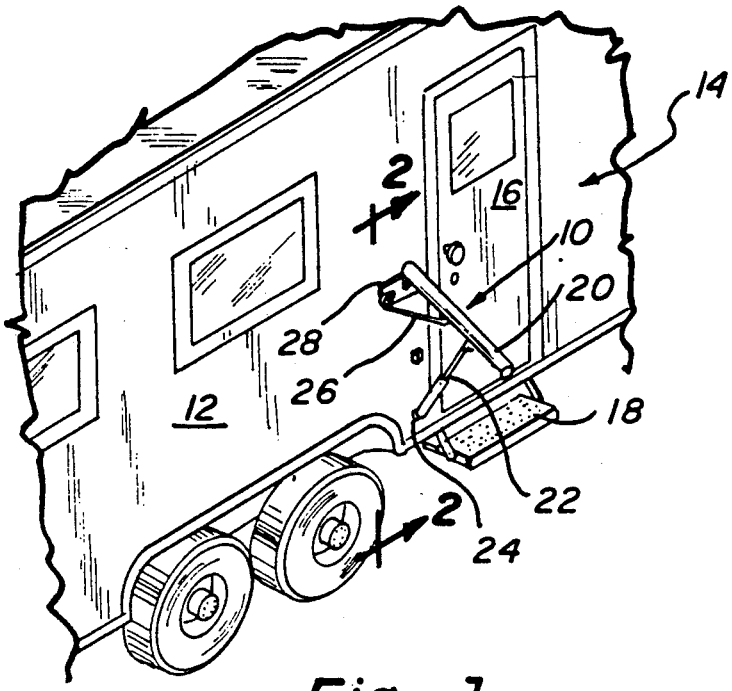
FIG. 1 is a perspective view of a trailer having a foldable handrail assembly constructed in accordance with the invention attached to an outer wall of the trailer adjacent to an entrance to the trailer with a stabilizer rod component mounted in an upper position with respect to a handrail which is shown in an extended position.
Figure 5:
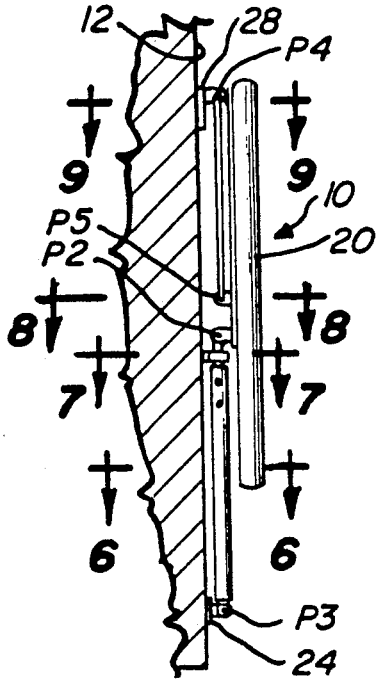
FIG. 5 is a side elevation view taken along line 5—5 of FIG. 4.
Figure 2:
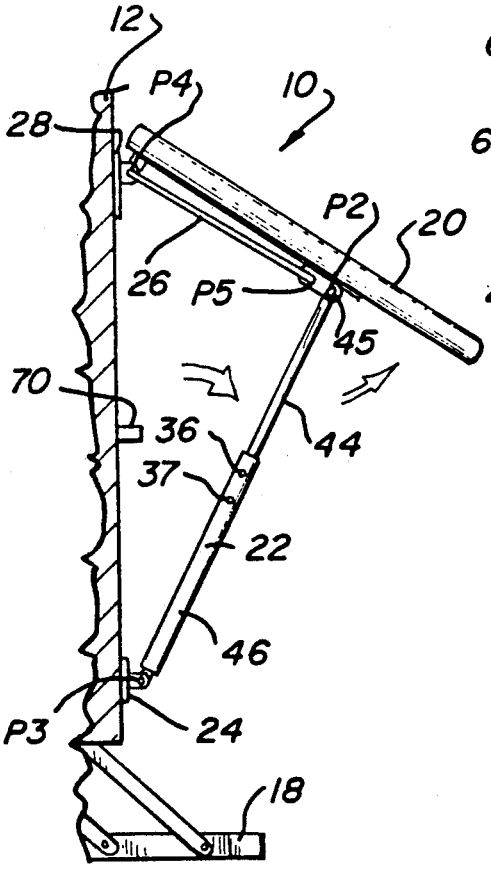
FIG. 2 is a side elevation view taken along line 2—2 of FIG. 1.

Referring now to FIGS. 1 and 2, a foldable handrail assembly constructed in accordance with the invention is shown and generally designated as 10. The foldable handrail assembly 10 is shown mounted to the sidewall 12 of a trailer 14. The trailer 14 includes an entrance or doorway 16 with a folding stairstep 18. The foldable handrail assembly 10 is intended for use with the entrance 16 and stairstep 18 and can be extended outwardly and downwardly and locked at an angle for use with the stairstep 18, as shown in FIG. 1, or retracted and folded flat against the trailer wall 12 in a downwardly extending storage position as shown in FIG. 5.

The foldable handrail assembly 10 simply stated includes a handrail 20, a first support brace in the form of a length adjustable brace 22, mounting bracket means in the form of a first mounting bracket 24, a second support brace in the form of a stabilizer rod 26 and mounting bracket means in the form of a stabilizer rod mounting bracket 28.

Figure 11:
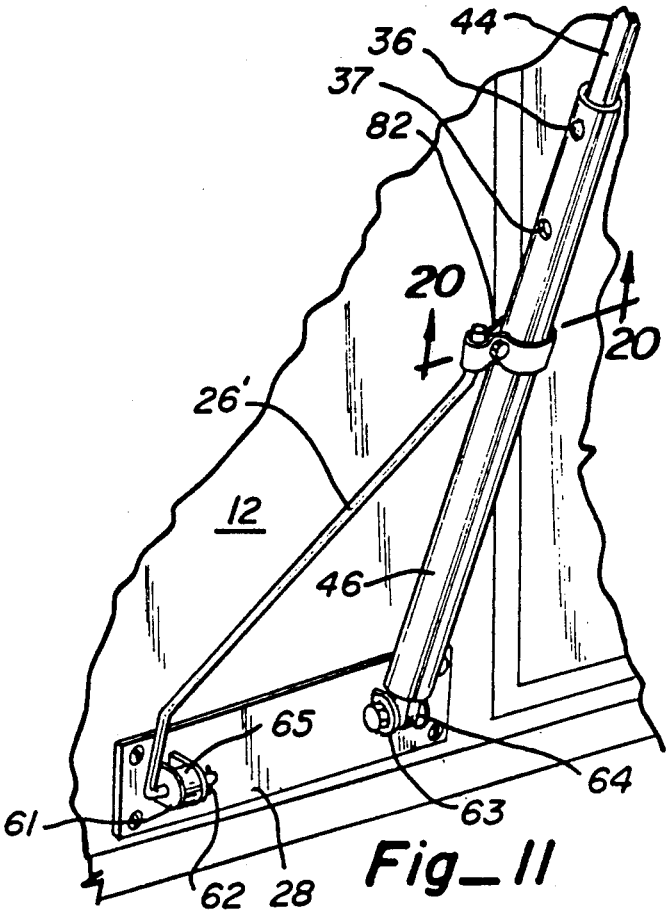
FIG. 11 is an enlarged view of a portion of FIG. 10.
Figure 10:
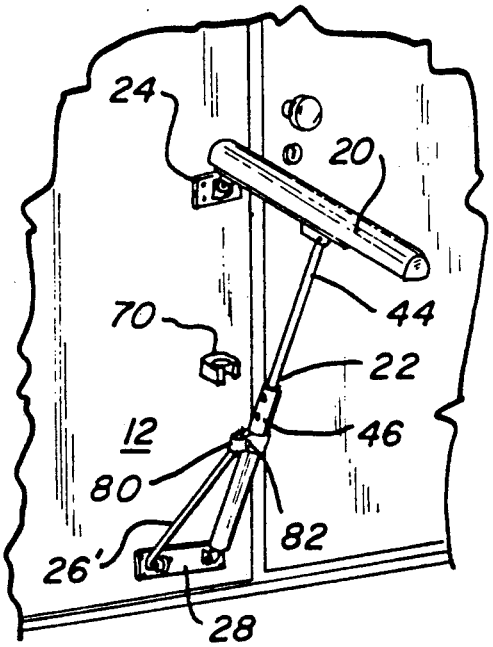
FIG. 10 is a perspective view of a foldable handrail assembly constructed in accordance with the invention shown mounted adjacent to a doorway of a trailer with a stabilizer rod component mounted in a lower position with respect to a handrail which is shown in an extended position.
Figure 18:
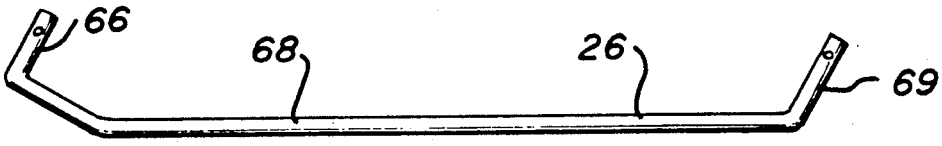
FIG. 18 is a plan view of a stabilizer rod component of a handrail assembly constructed in accordance with the invention for mounting in an upper position with respect to the handrail.
Figure 19:
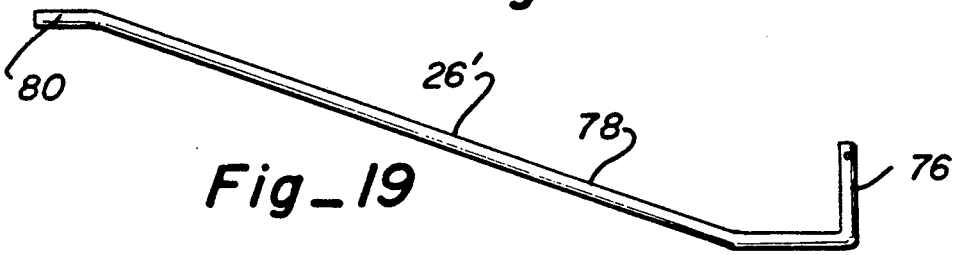
FIG. 19 is a plan view of an alternate stabilizer rod component of a handrail assembly constructed in accordance with the invention for mounting in a lower position with respect to the handrail.

As will hereinafter be more fully explained, the stabilizer rod 26 and stabilizer rod mounting bracket 28 can be mounted to the trailer wall 12 in either an upper position with respect to the handrail 20 as shown in FIGS. 1-9 or a lower position as shown in FIGS. 10 and 11. Likewise, the first mounting bracket 24 can be mounted in either a lower (FIG. 2) or upper (FIG. 10) position depending on the location of the stabilizer rod 26 and stabilizer rod mounting bracket 28. For mounting in an upper portion with respect to the handrail 20, a stabilizer rod 26 shaped as shown in FIG. 18 is utilized. For mounting in a lower position with respect to the handrail 20, a stabilizer rod 26′ shaped as shown in FIG. 19 is utilized.

In addition to an upper 26 or lower 26′ stabilizer rod mounting arrangement, the handrail assembly 10 can be mounted either to the left or to the right of the trailer entrance 16.

The different mounting positions allow the handrail assembly 10 to be more easily retrofitted to an already manufactured structure such as the trailer wall 12 and helps prevent interference problems with existing components of the existing structure.

As shown in FIGS. 2-5 in an upper mounting position of the stabilizer rod 26, the handrail 20, as well as the length adjustable support brace 22 and the stabilizer rod 26, are each pivotable about at least two pivots points. The handrail 20 is adapted to pivot at an inner end from pivot connection P1 at the trailer wall 12 and at a pivot connection P2 and P5 along the length of the handrail. The length adjustable support brace 22 is adapted to pivot at pivot connection P2 along the length of the handrail and at pivot connection P3 at the trailer wall 12. The stabilizer rod 26 is adapted to pivot from pivot connection P4 at the trailer wall 12 and at pivot connection P5 along the length of the handrail 20. In general, pivot connections P1, P2, P3 and P5 are coaxially aligned along a vertical center line and pivot connections P1 and P4 are coaxially aligned along a horizontal center line with P4 axially horizontally offset from the vertical center line of P1-P5.

Referring to FIGS. 6-9 and 12, the handrail 20 of the foldable handrail assembly 10 is clearly shown. The handrail 20, has a smooth top surface 30 which is generally hemispherical in cross section and which is suitable for sliding contact with a user's hand. This top surface 30 of the handrail 20 may be fabricated from a relatively soft material such as wood or plastic.

Figure 12:
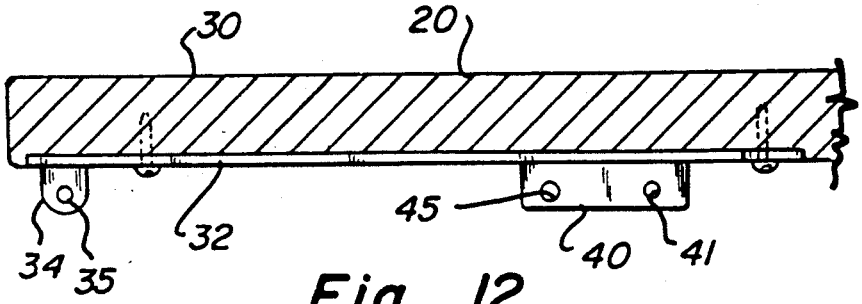
FIG. 12 is an enlarged partial side elevation view of a portion of the handrail component of a foldable handrail assembly constructed in accordance with the invention.
Figure 13:
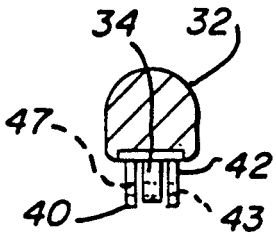
FIG. 13 is an end view of FIG. 12.

As clearly shown in FIG. 12, a flat metal plate 32 or a flat mounting area is attached or formed on the underside of the handrail 20. The flat metal plate 32 functions as a mount for mounting three pivot plates for pivotally attaching the handrail at P1 to the stabilizer rod mounting bracket 28 (or to first mounting bracket 24), at P2 to the length adjustable brace 22, and at P5 to the stabilizer rod 26. A first single pivot plate 34 having a mounting hole 35 is provided for pivotally attaching the inner end of the handrail 20 at P1. Second and third paired pivot plates 40, 42 (FIG. 13) are formed with aligned pairs of mounting holes (41, 43), (45, 47) for attaching the upper end of the length adjustable brace 22 at (P2) and the stabilizer rod 26 at (P5). All three of the pivot plates 34, 40, 42 are preferably metal and are preferably fixedly attached to the flat metal plate 32 of the handrail 20 by welding or the like.

Referring now to FIG. 2, the length adjustable brace 22 of the foldable handrail assembly 10 is clearly shown. The length adjustable brace 22 is an extendable brace which holds the handrail against vertical movement. The length adjustable brace 22 includes a pair of hollow nested tubular sections, an inner tubular section 44, and an outer tubular section 46. The inner tubular section 44 is sized to nest within and telescope from the outer tubular section 46. The outer tubular section 46 is formed with an inside diameter sized to abut and support the outside diameter of the inner tubular section 44. As is apparent, the inner tubular section 44 of the length adjustable brace 22 may be extended or telescoped from outer tubular section 46 for extending the handrail 20 outwardly and downwardly from the trailer wall 12 and supporting the handrail 20 against vertical movement. Likewise, the inner tubular section 44 of the length adjustable brace 22 may be retracted within the outer tubular section 46 for retracting the handrail assembly 10 to fold the handrail 20 flat against the trailer wall 12 in a downwardly extending folded position as shown in FIG. 5.

The handrail 20 is pivotally attached to the upper end of the length adjustable brace 22 (P2) using the aligned mounting holes 45, 47 in the pivot plates 40, 42 (FIGS. 12, 13) on the mounting plate 32 of the handrail 20. The inner section 44 of the length adjustable brace 22 is formed with a flat upper end portion having a through hole that can be aligned with and pivotally attached at the first pair of mounting holes 45, 47 (P2) of the handrail 20 using a pivot bolt 45 (FIG. 2) or the like. The handrail 20 thus pivotally attaches to the length adjustable brace 22 at (P2) at a point along the length of the handrail. The handrail 20 can thus be supported in an extended position by the length adjustable brace 22.

The foldable handrail assembly 10 also includes locking means for locking the tubular sections 44, 46 of the length adjustable brace 22 in an extended position for use. The locking means includes a spring loaded ball detent 48 (FIG. 6) mounted within the inner tubular section 44. The ball detent 48 includes a pair of spring loaded ball members 50, 52 that engage corresponding pairs of aligned holes 36 (FIG. 2), through the sidewalls of the outer tubular section 46 of the length adjustable brace 22 to lock the sections together in the extended position. A second pair of aligned holes 37 (FIG. 2) in the outer tubular section located below holes 36, provide an adjustment for the positioning the handrail 20 at a different lower angle in the extended position.

Figure 14:
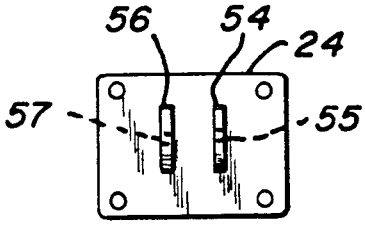
FIG. 14 is a side elevation view of a first mounting bracket component of a foldable handrail assembly constructed in accordance with the invention.
Figure 15:
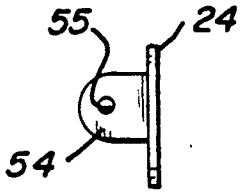
FIG. 15 is an end elevation view of FIG. 14.

Referring now to FIGS. 14 and 15 the first mounting bracket 24 of the foldable handrail assembly 10 is shown. The first mounting bracket 24 is adapted to be fixedly attached to the trailer wall 12 using threaded fasteners or through holes therein, an adhesive, or the like. With the stabilizer rod 26 mounted in an upper position, the first mounting bracket 24 functions as a pivot attachment for pivotally attaching the lower end of the length adjustable brace 22 to the trailer wall 12 at P2. The first mounting bracket 24 is a flat plate that includes a pair of parallel pivot plates 54, 56 fixedly attached to the mounting bracket 24 and each having a matching aligned through hole 55 or 57. The outer tubular section 46 of the length adjustable brace 22 is formed with a flat lower end having a corresponding through hole. The length adjustable brace 22 can thus be pivotally attached at its lower end to the aligned holes 55, 57 of pivot plates 54, 56 using a pivot bolt or the like.

Figure 16:
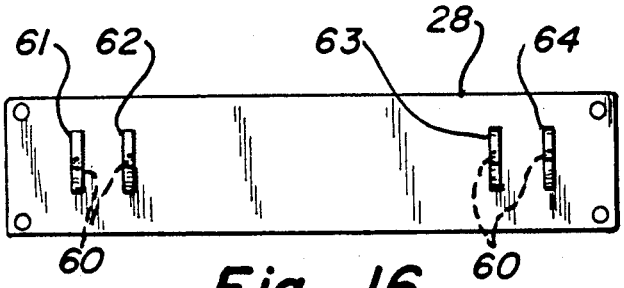
FIG. 16 is a side elevation view of a stabilizer rod mounting bracket component of a foldable handrail assembly constructed in accordance with the invention.
Figure 17:
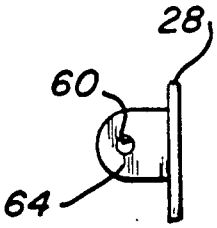
FIG. 17 is an end view of FIG. 16.

The stabilizer rod mounting bracket 28 is shown in detail in FIGS. 16 and 17. The stabilizer rod mounting bracket 28 is adapted to be fixedly attached to the trailer wall 12 using threaded fasteners, extending through holes therein, an adhesive, or the like. The stabilizer rod mounting bracket 28 includes a first pair of parallel pivot plates 61, 62 with through aligned coaxial holes 60, and a second pair of parallel pivot plates 63, 64 also with through aligned coaxial holes 60. The two pairs of pivot plates (61, 62), (63, 64) of the stabilizer rod mounting bracket 28 are adapted to pivotally mount the stabilizer rod 26 or 26' at P4 and either the inner end of the handrail 20 at P1 or the lower end of the length adjustable brace 22 at P3 depending on the location of the stabilizer rod 26 (upper or lower position).

Figure 3:
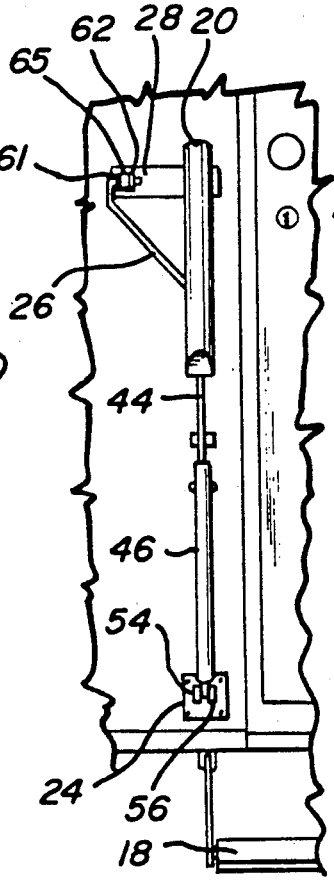
FIG. 3 is a front elevation view of a foldable handrail assembly constructed in accordance with the invention shown mounted to a trailer wall and shown with a stabilizer rod component mounted in an upper position with respect to a handrail which is shown in an extended position.
Figure 4:
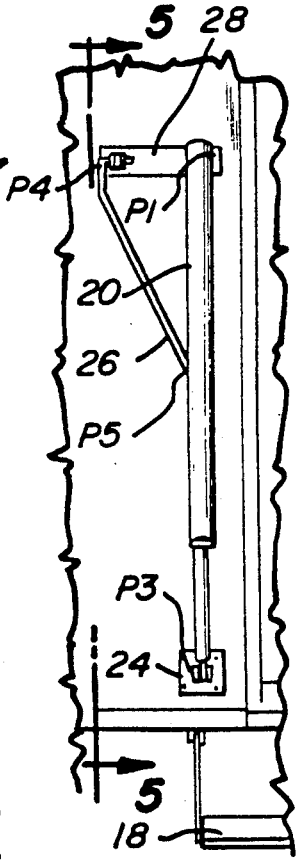
FIG. 4 is a front elevation view of a foldable handrail assembly constructed in accordance with the invention shown mounted to a trailer wall and with a stabilizer rod component mounted in an upper position with respect to a handrail which is shown in a retracted position folded against the wall generally parallel to the wall.
Figure 6:
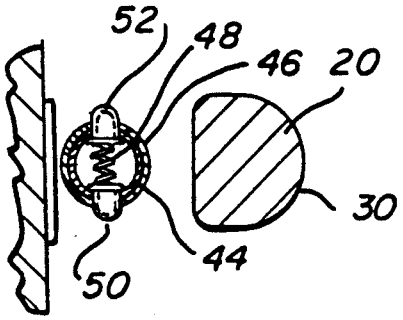
FIG. 6 is a cross sectional view taken along line 6—6 of FIG. 5.

For attaching the stabilizer rod 26 to the first pair of pivot plates 61, 62 and as shown in FIG. 3, a wear resistant bushing 65 having a central opening is placed between the pivot plates 61, 62. The end of the stabilizer rod 26 is placed through this bushing 65 and opening 60 of the pivot plates 61, 62 and then secured for pivotable movement with a fastener such as snap rings secured to the outside of the stabilizer rod 26 or set screws placed through the bushing 65 and against the stabilizer rod 26.

Referring now to FIG. 18, the stabilizer rod 26 (for mounting the stabilizer rod in an upper position) is shown separately. The stabilizer rod 26 may be fabricated from a material such as cylindrical metal stock that can be bent and formed in the required shape. This shape is symmetrical such that the stabilizer rod 26 can be mounted either to the left or to the right of the handrail 20. As shown in FIG. 18, this symmetrical shape includes an outer end portion 66 for attachment to the pivot plates 61, 62 of the stabilizer rod mounting bracket 24 at P4, an angled or inclined intermediate portion 68, and an inner end portion 69 for attachment to pivot plates 40, 42 of the handrail 20 at P5. End portions 66 and 69 extend parallel to one another. As before, setscrews, snap rings, and wear bushings can be utilized to pivotally secure the stabilizer rod 26 to the pivot plates 40, 42. The stabilizer rod 26 thus rigidifies the foldable handrail assembly 10 and helps prevent lateral movement of the handrail 20 in the extended position.

As is apparent, in use the handrail 20 pivots at its inner end from the trailer wall 12 at P1 and is supported against vertical movement at P2 by the length adjustable brace 22. The locking means of the length adjustable brace 22 locks the handrail 20 at a desired angle herein shown as two set locations in an extended position. The stabilizer rod 26 of the handrail assembly 10 provides additional support at P5 for the handrail 20 and prevents lateral movement of the handrail 20.

Figure 7:
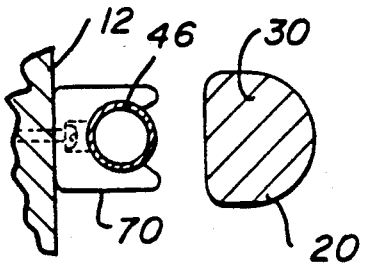
FIG. 7 is a cross sectional view taken along line 7—7 of FIG. 5.
Figure 8:
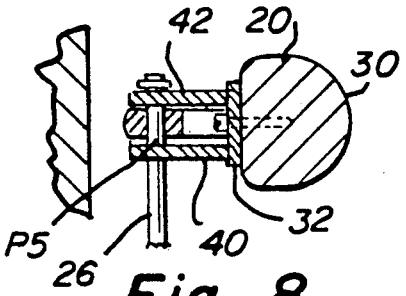
FIG. 8 is a cross sectional view taken along section line 8—8 of FIG. 5.
Figure 9:
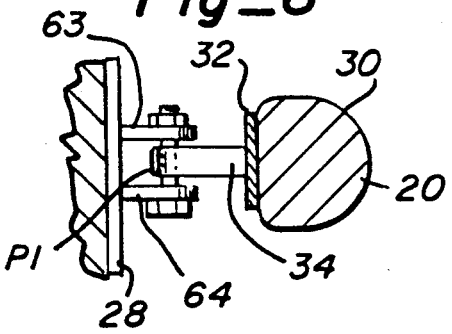
FIG. 9 is a cross sectional view taken along section line 9—9 of FIG. 5.

A final component of the foldable handrail assembly 10 includes clip means fixedly attached to the trailer wall 12. As shown in FIGS. 2 and 7, the clip means comprises a clip 70 sized to receive the outer tubular section 46 of the length adjustable brace 22 and hold the length adjustable brace 22 and handrail 20 against the trailer wall 12. The clip 70 is shaped and sized such that the outer tubular section 46 of the length adjustable brace 22 may be pressed or snap fit into the clip 70 and releasably held with the handrail 20 in a downwardly extending folded or retracted position as shown in FIG. 5. The clip 70 is also shaped such that the outer tubular section 46 of the length adjustable brace 22 may be easily pulled out of the clip 70 for extending (FIG. 2) the handrail 20 for use.

In FIGS. 10 and 11 the stabilizer rod is shown mounted to the trailer wall 12 in a lower position with respect to the handrail 20. The lower mounting position of the stabilizer rod requires a different shaped stabilizer rod which is shown separately in FIG. 19 and designated 26'. As before the lower mounting stabilizer rod 26' is formed of a material such as cylindrical metal stock and is formed symmetrically for left or right hand mounting. The lower mounting stabilizer rod 26' includes an inner end 76 for mounting to the pivot plates 61, 62 of the stabilizer mounting bracket 28, an angled or inclined intermediate portion 78, and a vertical outer end portion 80.

With reference to FIGS. 10 and 11 in the lower position of the stabilizer rod 26', the lower end of the length adjustable brace 22 pivotally mounts to the pivot plates 63, 64 of the stabilizer rod mounting bracket 28. The upper end of the handrail section 20 now pivotally attaches to pivot plates 54, 56 of the first mounting bracket 28. The first mounting bracket 28 in turn is now attached to the trailer wall 12 in an upper position.

In the lower mounting position the inner end portion 76 of the lower mounting stabilizer rod 26', mounts as shown in FIG. 11 between pivot plates 61, 62 of the stabilizer rod mounting bracket 28. Again, a bushing 65 along with setscrews or snap rings can be utilized to pivotally attach the inner end portion 76 to the pivot plates 61, 62.

Figure 20:
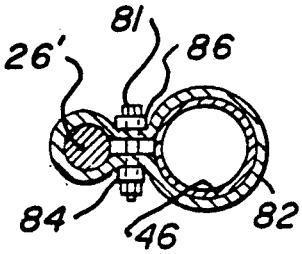
FIG. 20 is an enlarged cross sectional view taken along line 20—20 of FIG. 11.

A mounting difference occurs between the upper and lower positions of the stabilizer rod 26 or 26'. This difference is the use of a clamp 82 for attaching the vertical outer end portion 80 of the lower mounting stabilizer rod 26'. As shown in FIG. 20, the clamp 82 is split and attaches around outer tubular section 46 of the length adjustable brace 22 at an intermediate portion, and around the vertical outer end portion 80 of the stabilizer rod 26'. The split clamp 82 is sized and shaped to engage both the stabilizer rod 26' and the outer tubular section 46. Threaded fasteners 83 placed through reinforcing plates 84, 86 join the split portions of the clamp 82 together engaging the stabilizer rod 26' and outer tubular section 46 of the length adjustable brace 22.

Thus, the construction of the folding handrail assembly allows the stabilizer rod component 26 or 26' to be easily mounted in more than one position. As is apparent, in addition to an upper or lower mounting position, the foldable handrail assembly 10 can be mounted either to the left or the right of the trailer entrance 16.

Although the present invention has been described with a certain degree of particularity, it is understood that the present disclosure has been made by way of example and that changes in details of structure may be made without departing from the spirit thereof.

What is claimed is:

1. A foldable handrail assembly for use on either side of a doorway in a wall of an enclosure, said assembly comprising:

a handrail having an inner end portion and an outer end portion;

said inner end portion being pivotally mounted adjacent a doorway in a wall of an enclosure at a pivotal connection with said wall to pivot about a first pivot so that said handrail will swing between an outwardly projecting extended position and a downwardly extended folded position;

a length adjustable first support brace having a lower end portion and an upper end portion arranged for holding said handrail against vertical movement in said outwardly extended position, said first support brace being movable to a folded position;

said lower end portion being pivotally mounted to said wall adjacent said doorway and in substantially vertical alignment with said first pivot to pivot about a second pivot;

said upper end portion being pivotally mounted at a pivotal connection with said handrail, and in substantially vertical alignment with said first pivot along said handrail to pivot about a third pivot;

said first support brace having locking means for locking said first support brace against lengthwise movement in said extended position;

a second support brace having an inner end and an outer end for holding said handrail and first support brace against lateral movement in said extended position;

said second support brace having said inner end pivotally mounted at a pivotal connection with said wall at a fourth pivot located at an upper position laterally out to one side of said inner end portion of said handrail and first support brace and said outer end pivotally mounted to a pivotal connection with said handrail at a fifth pivot;

the mounting for said handrail, first support brace and second support brace to said wall being provided by mounting bracket means mounted on said wall to secure said handrail, first support brace and second support brace to said wall;

said mounting bracket means including a first mounting bracket for pivotally mounting said inner end portion of said handrail and said inner end portion of said second support brace to said wall; and said mounting bracket means including a second mounting bracket for pivotally mounting said lower end of said first support brace to said wall.

2. A foldable handrail assembly as set forth in claim 1 wherein said mounting bracket means includes a mounting plate and two sets of pivot plates with said sets being in spaced aligned relationship along said mounting plate, said pivot plates having aligned holes.

3. A foldable handrail assembly as set forth in claim 2 wherein said second support brace is in the form of an elongated rod having a first outer end portion that slides into said holes of one of said pair of pivot plates, an inclined intermediate portion and s second inner end portion that slides into at least one hole in a pivot plate on the underside of said handrail said first and second end portion being generally parallel to one another.

4. The foldable handrail assembly as claimed in claim 3 wherein said locking means includes a ball detent having spring loaded ball members that engage through holes in an inner and outer telescoping sections.

5. The foldable handrail assembly as claimed in claim 2 and wherein said length adjustable brace includes telescoping sections with an inner section nested within and moveable relative to an outer section.

6. The handrail assembly as claimed in claim 1 and further including clip means attached to said wall for retaining said handrail in a folded position.

7. A foldable handrail assembly for use with an entrance in a wall of a structure said handrail comprising;

a handrail pivotally connected at an inner end to the wall to swing between an outwardly projecting extended position and a folded position;

a length adjustable brace pivotally connected at a lower end to the wall and pivotally connected at an upper end to said handrail for holding said handrail against vertical movement in the outwardly projecting position;

an upper stabilizer rod pivotally attached to the wall at an inner end and pivotally attached to the handrail at an outer end;

locking means for locking said length adjustable brace in the extended position;

a first mounting bracket attached to the wall and including a pivot mount for pivotally attaching to the lower end of said length adjustable brace to said wall; and a second mounting bracket attached to the wall and including a pivot mount for said stabilizer rod and a pivot mount for the inner end of said handrail located at an upper position laterally out to one side of said inner end portion.

8. A foldable handrail assembly as claimed in claim 7 and further comprising clip means for retaining said handrail against the wall of the structure in the folded position.

9. A foldable handrail assembly as claimed in claim 8 and wherein said length adjustable brace comprises two telescoping sections, an inner tubular section nested within and extendable from an outer tubular section.

10. A foldable handrail assembly as claimed in claim 9 and wherein said locking means comprises a ball detent mounted in said inner tubular section and having ball members which engage holes in said outer tubular section and with a said outer tubular section having more than one pair of holes axially spaced along said outer tubular section to provide length adjustments for said length adjustable brace.

11. A foldable handrail assembly for use on either side of an entrance in a wall of an enclosure, said assembly comprising:

a handrail having an inner end portion and an outer end portion;

said inner end portion being pivotally mounted adjacent the entrance in the wall of the enclosure at a pivotal connection with said wall to pivot about a first pivot so that said handrail will swing between an outwardly projecting extended position and a downwardly extending folded position;

a length adjustable first support brace having a lower end portion and an upper end portion arranged for holding said handrail against vertical movement in said outwardly extended position and moving to a folded position;

said lower ned portion being pivotally mounted to said wall adjacent said entrance and in substantially vertical alignment with said first pivot to pivot about a second pivot;

said upper end portion being pivotally mounted at a pivotal connection with said handrail said first pivot along said handrail to pivot about a third pivot;

said first support brace having locking means for locking said first support brace against lengthwise movement in said extended position;

a second support brace having an inner end portion and an outer end portion for holding said handrail and first support brace against lateral movement in said extended position;

said second support brace having said inner ned portion pivotally mounted at a pivotal connection with said handrail at a fourth pivot located at an upper position laterally out to one side of said inner end portion and said outer end portion pivotally mounted at a pivotal connection with said handrail at a fifth pivot;

the mounting for said handrail, first support brace, and second support brace being provided by mounting bracket means mounted on said wall to secure said handrail, first support brace and second support brace to said wall;

said mounting bracket means including a first mounting bracket for pivotally mounting said lower end portion of said second support brace to said wall, and a second mounting bracket for pivotally mounting said inner end portion of said handrail and said inner end portion of said second support brace to said wall at said upper position.

12. A foldable handrail assembly as set forth in claim 11 and further comprising clip means for retaining said handrail in a folded position.

13. A foldable handrail as claimed in claim 12 and wherein said second mounting bracket includes two pairs of pivot plates each having a through aligned hole.

14. A foldable handrail as claimed in claim 13 and wherein said first mounting bracket includes a pair of pivot plates each having a through aligned hole.

15. A foldable handrail assembly as claimed in claim 14 and wherein a wear resistant bushing having a through hole is placed between a pair of pivot plates on said second mounting bracket for pivotally attaching said second support brace to said second mounting bracket.

16. A foldable handrail assembly for use on either side of a doorway in a wall of an enclosure, said assembly comprising:

a handrail having an inner end portion and an outer end portion;

said inner end portion being pivotally mounted adjacent a doorway in a wall of an enclosure at a pivotal connection with said wall to pivot about a first pivot so that said handrail will swing between an outwardly projecting extended position and a downwardly extending folded position.

a length adjustable first support brace having a lower end portion and an upper end portion arranged for holding said handrail against vertical movement in said outwardly extended position and moving to a folded position;

said lower end portion being pivotally mounted to said wall adjacent said doorway and in substantially vertical alignment with said first pivot to pivot about a second pivot;

said upper end portion being pivotally mounted at a pivotal connection with said handrail, said first pivot along said handrail to pivot about a third pivot;

said first support brace having locking means for locking said first support brace against lengthwise movement in said extended position;

a second support brace having an inner end portion and an outer end portion for holding said connected handrail and first support brace against lateral movement in said extended position;

said second support brace having said inner end portion pivotally mounted at a pivotal connection with said wall at a fourth pivot located at an upper position laterally out to one side of said inner end portion and said outer end portion mounted at a pivotal connection with said handrail;

the mounting for said handrail, first support brace and second support brace being provided by mounting bracket means mounted on said wall to secure said handrail, first support brace and second support brace to said wall;

said mounting bracket means including a first mounting bracket for pivotally mounting said lower end portion of said first support brace to said wall and a second mounting bracket for pivotally mounting said inner end portion of said second support brace and said inner end portion of said handrail to said wall.

17. The foldable handrail assembly as set forth in claim 16 and wherein said first support brace is attached to said second support brace by a clamp.

* * * * *